United States Patent [19]

Kuhn

[11] 4,338,760

[45] Jul. 13, 1982

[54] CARRIER PACK FOR A NUMBER OF BOTTLES AS WELL AS THE PROCESS AND APPARATUS NEEDED TO CLOSE THE PACK

[75] Inventor: Werner Kuhn, Buchenberg, Fed. Rep. of Germany

[73] Assignee: International Actrooi Maatschappy "Octropa" B.V., Rotterdam, Netherlands

[21] Appl. No.: 210,160

[22] Filed: Nov. 25, 1980

[30] Foreign Application Priority Data

Dec. 3, 1979 [DE] Fed. Rep. of Germany ..... 2948598

[51] Int. Cl.[3] ..... B65B 21/24

[52] U.S. Cl. ..... 53/48; 53/590; 53/209

[58] Field of Search ..... 53/398, 48, 484, 582, 53/590, 209

[56] References Cited

U.S. PATENT DOCUMENTS

| | | | |
|---|---|---|---|
| 1,968,877 | 8/1934 | Cubberley | 206/197 |
| 3,045,401 | 7/1962 | Ganz | 53/48 |
| 3,410,397 | 11/1968 | Cato | 53/398 X |
| 3,815,320 | 6/1974 | Ganz | 53/48 |

FOREIGN PATENT DOCUMENTS

| | | | |
|---|---|---|---|
| 1611838 | 8/1978 | Fed. Rep. of Germany . | |
| 2810564 | 9/1979 | Fed. Rep. of Germany | 53/48 |

*Primary Examiner*—John Sipos

*Attorney, Agent, or Firm*—Cushman, Darby & Cushman

[57] ABSTRACT

The invention relates to a carrier pack for a number of bottles or similar objects that are produced with a relatively large tolerance in their diameter. The carrier pack consists of a blank that is wrapped around the bottles or similar objects. The two ends of the blank overlap where they are joined. At least one of these two ends has incisions which extend into the side wall next to respective the end section. The incisions are preferably positioned beside the bottles or similar products, which means that tabs are formed that are as wide as the bottles.

The closing process for the carrier pack involves the individual tabs of an end section being pressed onto the other end section separately and elastically according to the dimensions of the bottles or similar objects, until the bottles are firmly held in place.

The apparatus needed to close the carrier pack involves fingers attached to a chair mechanism. These fingers engage with edges of the blank at the end of the same. These fingers are elastic under pressure, which means that the tabs are able to compensate for possible tolerances in the dimensions of the bottles or similar objects.

3 Claims, 8 Drawing Figures

CARRIER PACK FOR A NUMBER OF BOTTLES AS WELL AS THE PROCESS AND APPARATUS NEEDED TO CLOSE THE PACK

The invention relates to a carrier package or collective package for bottles or similar objects and consists of a blank which is put around the objects to be packaged and which after covering the objects is closed by an overlapping joint of its end zones. The invention also relates to the process of closing the blank while in particularly tight and firm contact with the objects, and to the device provided for this purpose, which forms part of a machine for manufacturing the packages.

A large number of packages for a group of bottles, cans or similar articles is known in which such a group is enveloped by a cardboard blank, the blank being locked at the bottom or on the top side of the package by locking elements or by gluings.

A bottom-locked blank of this type is, for example, shown in German Patent Application No. 1,611,838. It is also proposed here to draw the blank uniformly tight around the group of objects by using fingers that can move towards one another, engage in the openings of the blank and push the partly overlapping bottom parts together.

From German Pat. Appln. No. 2,810,564 a folder is known which is closed by means of tuck-in tabs and the bottom flaps of said folder are drawn together farther or less far so as to adapt them to any occurring size deviations of the packaged bottles, and are locked in the final position. However, also this folder can only be drawn together as far as is allowed by the largest dimensions of the bottles that determine the cross-section of any particular package, so that smaller bottles that happen to be present in a package are not kept in place.

A uniform pushing together of the end zones of a blank before and during closing may indeed result in a relatively tight enclosure of the group of objects within the blank, but the individual objects in the group are only kept in place if the dimensions of the objects that determine the cross-section of the package and possibly also the dimensions of the blank are fully identical. However, for example return bottles show considerable differences in dimensions. If a package contains six bottles standing in pairs beside each other, it may occur that a pair with maximum admissible dimensions, which determines the cross-section of the package, stands beside a pair with minimum admissible dimensions with which the blank is no longer in tight contact.

It is an object of the invention to hold several objects in a carrier package in such a way that also in the case of size deviations of individual objects requiring somewhat different cross-sections of the package all objects are tightly and firmly enclosed by the blank.

According to the invention the end zones of the package blank to be joined and the blank parts adjacent to these end zones are divided by incisions into tabs, and these tabs are pushed together individually and connected tightly around the objects enclosed by them. This solution makes it possible to use, for each of the possibly different cross-sections of the package, a smaller or larger overlap of the ends of the blank and to adapt the circumference of the cross-section of the package to the dimensions of the packaged objects in such a way that all objects are tightly enclosed.

The tabs and the incisions dividing them suitably extend over at least one edge or one inclined or bent edge panel of the package, so that, if necessary, also the edge and the end zones of adjacent parts of the blank can be deformed and tensioned. The end zones of the blank to be joined with an overlap can be the bottom panels of the package. It is also possible however to effect the overlapping closure of the package on another panel of the package, for example the top side. The joining of the two end zones of the blank is preferably effected by gluing or sealing. However, also hooked locks or the like can be applied, which on inserting a locking tongue into a slit, which can be done in different positions, result in the tongue being securely held in its inserted position. Incisions and tabs can be arranged in both end zones to be joined, in which case each time two opposite tabs are pushed together and joined. However, it may also be suitable to divide only one of the end zones into tabs and to fix these tabs on the other, non-divided end zone. Advantageously the incisions between the tabs are narrow punchings, yielding small spacings between the tabs, so that two adjacent tabs do not hinder each other while being pushed together. As a result of the punchings a strip of blank-material or a similar piece is removed. If the end zones to be closed are arranged on the top side of the pakcage, the incisions can be so wide as to allow the package to be carried with their help as by means of grip holes. The incisions are preferably arranged between the packaged objects. It would also be possible however to provide several incisions in the zone of each object enclosed within the blank and, by pushing the tabs together, deform the edge of the package comprised by the tabs in such a way that it partly follows a corresponding edge or shape of the object.

The tight enclosure of the objects by the blank and the pushing together of the tabs can be effected in different ways. Advantageously, as is known per se from German Pat. Appln. No. 1,611,838, openings are arranged in the end zones to be pushed together, the edges of which can be engaged by a pushing element. The openings can simultaneously serve to hold the objects.

In a preferred embodiment of the package the end zones of the blank to be joined are formed by the bottom parts of the package, and incisions and tabs extend from the edges of the bottom parts to within the lower part of the side walls, as well as across narrow lower edge panels which are arranged between bottom parts and side walls, in which embodiment the incisions are each time arranged between two objects standing on the bottom parts and butting against the side walls, and the tabs comprise a holding opening approximately in the area of the lower side edges.

In the process according to the invention each end zone and preferably each individual tab which is divided by incisions in an end zone of the blank and in wall parts adjacent to the latter, is pressed onto the other end zone under tension, according to the dimensions of the enclosed objects of the group to be packaged, and fixed in tensioned position to the other end zone.

Many packages for bottles etc. are provided with expansion lines around the holding openings, in the form of impressions or incisions, which to a limited degree enable the carboard to be deformed so as to adapt it to the roundings of the bottles. If end zones which have not been divided by incisions are uniformly pressed together, the edges of the holding openings are often tensioned only partly, particularly if bottle-shapes and -sizes are not identical.

In a further embodiment of the process according to the invention, therefore, the tabs separated from the end zones of the blank and the adjacent wall parts by incisions, in which the holding openings are arranged, are pushed together in such a way that thereby also the edges of the holding openings are stretched as far as possible in the peripheral direction of the package, to adapt them to shape and size of the parts of the objects projecting through the openings. This ensures that the deformation and stretching of the edges of the openings is effected to a maximum degree, before the tabs are joined to each other, thus excluding any later stretching of individual edges which would result in individual bottles getting loose.

An apparatus provided for carrying out the process, in particular with the package blanks according to the invention, comprising transport devices for the blanks and the objects, folding devices arranged on the transport devices for folding blanks around the objects and closing devices which, inter alia, possess pushing fingers guided on a chain, which engage at edges in the end zones of the blanks and push them together till they tightly contact the objects, is characterized in that pushing fingers are provided for each end zone of the blank and that each finger can be pushed separately and elastically by means of a spring supported against a support rail, in order to bring and end zone into a position in which it overlaps the other end zone as far as possible. Preferably a separate elastic pushing finger is used for each tab.

The invention can be realized in various embodiments, as was partly indicated before, and it can e.g. be used for collective packs for containers of different shapes and sizes in one group.

By way of example, a package for six bottles will be described below, said bottles being arranged in a group of three pairs in a cover which is closed at the bottom, in addition to which some examples will be shown for suitable parts of the device for closing this package.

Figure 4:
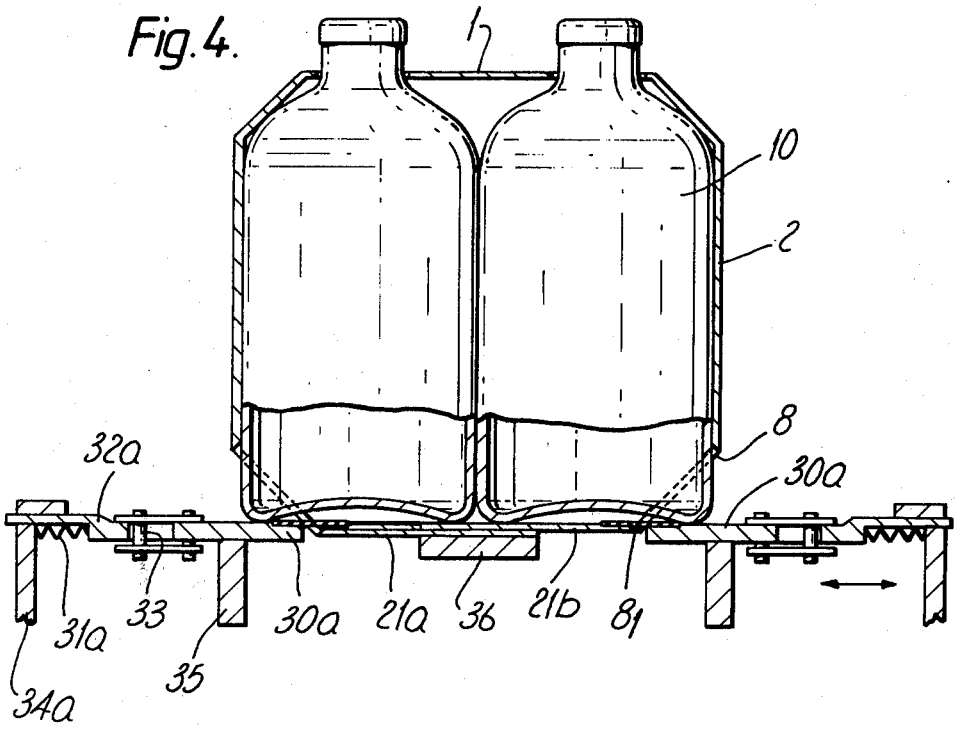
FIG. 4 is a section through a package with other tools for pushing the end zones together.
Figure 5:
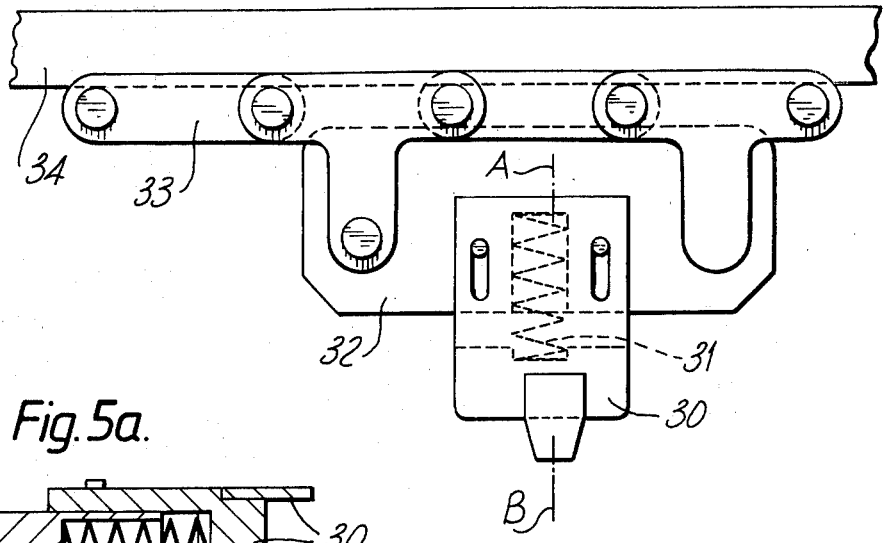
FIG. 5 is a top view of a tool according to FIG. 3.
Figure 5A:
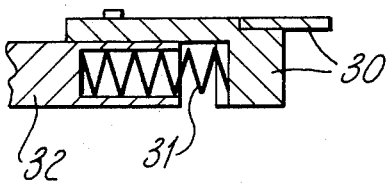
Figure 6:
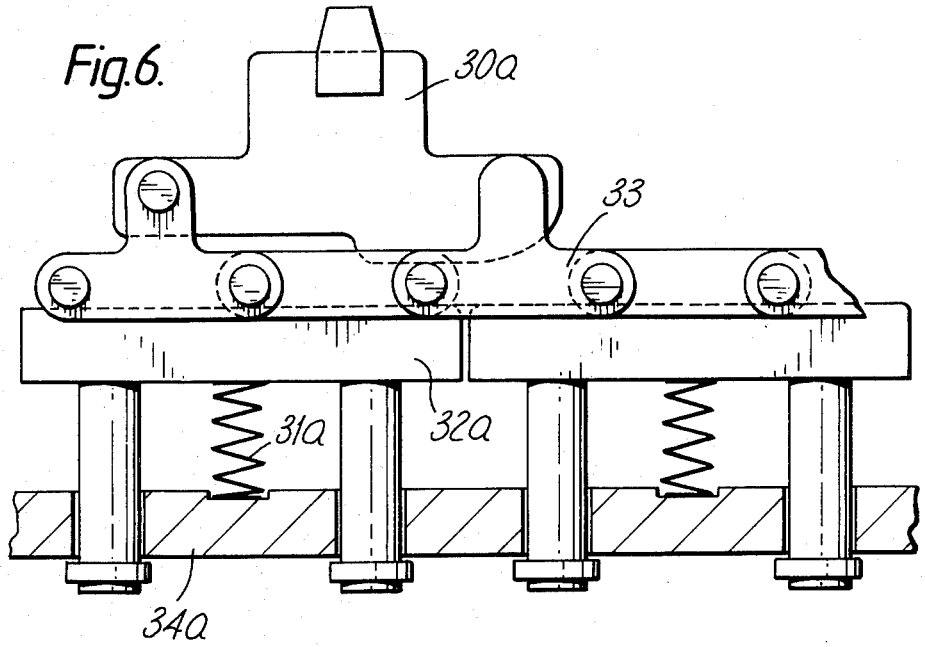
Figure 7:
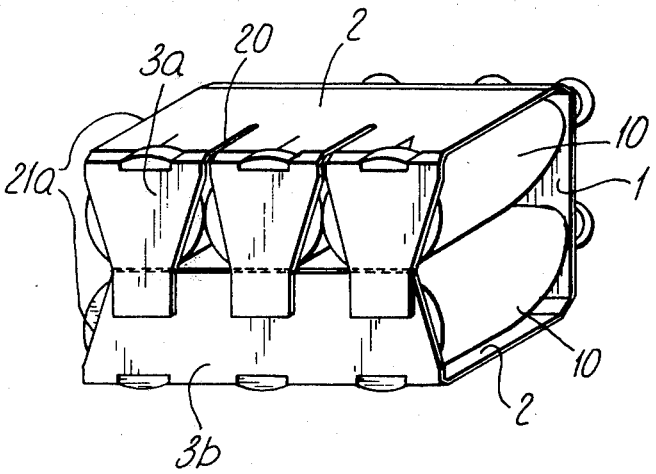

FIG. 5*a* is a section A—B according to FIG. 5;

FIG. 6 is a top view of a tool according to FIG. 4;

FIG. 7 shows a perspective view on the bottom of another package.

Figure 1:
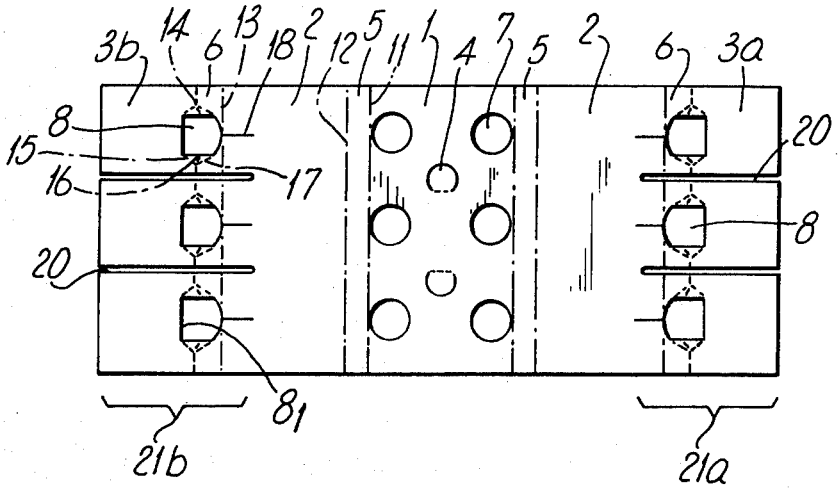
FIG. 1 shows a blank for the package.

The blank (FIG. 1) consists of a top panel 1 with holding openings 7 for the bottle necks and finger openings 4, two side walls 2, two bottom panels 3*a* and 3*b*, upper edge panels 5 and lower edge panels 6, in which holding openings 8 are located for the bottom parts of the bottles. The panels of the blank are separated from each other by fold lines 11, 12, 13, 14. At the lower holding openings 8 expansion lines 15, 16, 17 have been impressed and an incision 18 is provided, which allow an expansion and a limited deformation of the edges of the openings 8 in order to adapt them the lower parts of the bottles 18 that partly project from the package.

Figure 2:
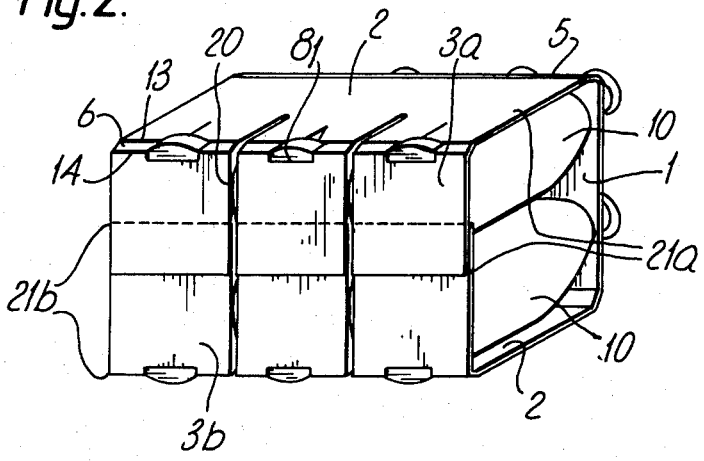
FIG. 2 shows a perspective view on the bottom of a filled package, closed at the bottom, from a blank according to FIG. 1.

The end zones of the package shown are formed by the bottom panels 3*a* and 3*b*, which are glued together in a partly overlapping position to close the package. In order to ensure that each individual pair of the bottles 10 standing in the package is tightly enclosed by the blank, also in the case of different dimensions or shapes of the bottles, the bottom panels 3*a*, 3*b* and the bottom zones of the side walls 2 as well as the lower edge panels 6 are divided by means of incisions 20 into tabs 21*a*, 21*b*. Each tab 21*a*, 21*b* thus comprises part of one of the bottom panels 3*a* or 3*b*, part of the lower edge panel 6 and part of the lower half of a side wall 2, and it extends across the lowermost edge of the package produced by the fold line 14, as well as across the further lower edge formed by the fold line 13 and contains a lower holding opening 8. On pushing together a pair of tabs 21*a*, 21*b* the blank is tightly drawn around the pair of bottles enclosed by these tabs, while also the bottles are compressed and the holding openings 8 are stretched. The inner cross-section of the package, particularly in its lower zone, is adapted to the bottles so as to ensure that each pair of bottles is firmly held according to its dimensions and essentially independent of an adjacent pair of bottles. The overlap of the individual pairs of tabs 21*a*, 21*b* can be different (FIG. 2). Therefore, if necessary, also the lower holding openings 8 can be stretched differently, corresponding to the radius of transition from body to bottom of the bottles.

FIG. 7 shows the bottom of a package in which incisions 22 and tabs 21*a* are present only in one end zone, e.g. in the bottom panel 3*a*, whereas the other bottom panel 3*b* as well as the adjacent parts of the blank are not divided by incisions.

Pushing the tabs 21*a* and 21*b* together is suitably effected after the blank has been folded around the bottles, by means of pushing fingers 30, which engage an appropriate spot on the tabs. In the example under review these pushing fingers 30 engage in the lower holding openings 8 and push against the edge 81, located under the bottles 10, of the openings 8. The pushing fingers 30 are loaded elastically towards each tab, so that each tab can individually be tensioned to the maximum extent.

Figure 3:
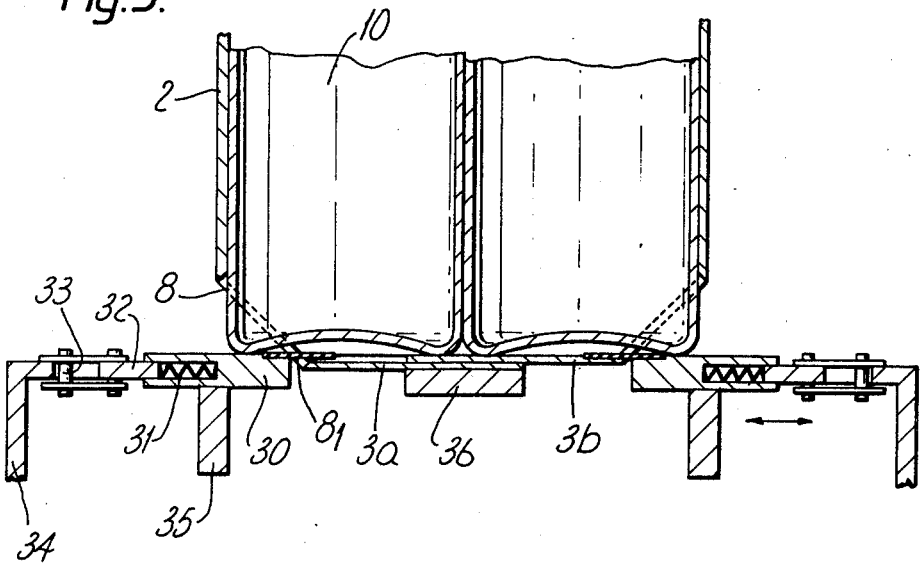
FIG. 3 shows a section through the lower part of a package and the tools for pushing the end zones together.

As is indicated in FIGS. 3 and 5, the pushing fingers 30 are fixed in an elastically movable way to a pressure block 32 via a pressurespring 31, the pressure block being guided on a roller chain 33, which roller chain is supported on a guiding rail 34. The fingers 30 run on a supporting rail 35. Pushing together of the bottom panels 3*a*, 3*b* and of the tabs 21*a*, 21*b*, respectively, takes place during the continuous transport of the packages through the packaging machine. The roller chains 33 pass the fingers 30 with the packages over part of the transport path. When the bottom panels 3*a*, 3*b* have been pushed together sufficiently far, they are pressed together by a pressure rail 36, while a previously applied adhesive effects sealing of the package. The fingers 30 are not drawn away from the sealed package until the adhesive has set.

In the apparatus shown in FIGS. 4 and 6 the fingers 30*a* are fixed direct to the roller chain 33, which however can be moved in the direction of pushing, by pressure blocks 32*a*, loaded elastically by means of springs 31*a*, the springs 31*a* being supported on a rail 34*a*. In order to ensure that here too, each finger 30*a* can push a tab 21*a*, 21*b* individually, the length of each pressure block is at most equal to the width of a tab.

The pushing together of the end zones 3*a*, 3*b* by individual elastic pushing fingers 30, 30*a* is also advantageous for those blanks in which the end zones are not divided into tabs.

I claim:

1. Apparatus for closing a carrier package for bottles or similar articles by surrounding the articles with a package blank, the package blank having an elongated first end for forming a first side and part of a second side of the package to be formed, the end being divided into a plurality of tabs by a plurality of slits each extending generally transverse to the direction of elongation of the end, and extending in both the part of the end forming a first side and forming part of a second side, and the blank having a second end opposite the first end, the package blank second end comprising an elongated end parallel to the first elongated end and for forming a third side and part of the second side of the package to be formed, the second end being divided into a plurality of tabs by a plurality of slits each extending generally transverse to the direction of elongation of the end, and extending in both the part of the end forming the third side and forming part of the second side; the apparatus comprising:

transport means for transporting the objects to be packaged, package blanks, and resulting filled packages;

folding means associated with the transport means for folding the blank around the objects; and closing means for pushing opposite ends of the blanks toward each around the objects so that the blank tightly engages the objects even when objects of differing diameter or cross-sectional area are packaged together, said closing means comprising: a plurality of fingers mounted in operative association with said elongated package blank first end as said package blank and objects are being transported by said transport means; each of said fingers having an operative width no greater than the length of a tab of the package blank first end in the dimension of elongation thereof; and further comprising spring biasing means for biasing each of said fingers individually inwardly with respect to the package blank so that each of said fingers engages a tab and pushes that tab only toward the package blank second end so that the package tightly engages the objects being packaged; and a plurality of fingers disposed in operative association with the package second end, each of said fingers having an operative width no greater than the length of a tab of the package blank second end; and spring biasing means for biasing each of said fingers individually inwardly with respect to the package blank so that each of said fingers engages a tab and pushes that tab toward the package blank first end so that the package tightly engages the objects being packaged.

2. Apparatus as recited in claim 1 wherein each of said fingers is mounted to an individual pressure block having a width no greater than the length of a tab, and wherein said pressure blocks are mounted to a chain which is movable along a stationary guide rail; and wherein said spring biasing means act between said pressure block and said spring finger.

3. Apparatus as recited in claim 2 further comprising a guide rail mounted beneath said spring fingers for providing support for said spring fingers while not affecting movement of said spring fingers under the influence of said biasing means.

* * * * *